US008415615B2

(12) United States Patent
Satoh et al.

(10) Patent No.: US 8,415,615 B2
(45) Date of Patent: Apr. 9, 2013

(54) INFORMATION ACQUISITION METHOD

(75) Inventors: Shuya Satoh, Yokohama (JP); Hiroyuki Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/351,675

(22) Filed: Jan. 17, 2012

(65) Prior Publication Data

US 2012/0181421 A1 Jul. 19, 2012

(30) Foreign Application Priority Data

Jan. 19, 2011 (JP) ..... 2011-008858

(51) Int. Cl.
*H01J 49/26* (2006.01)

(52) U.S. Cl. ..... 250/282; 250/281; 250/288; 252/408.1; 252/600; 436/173; 436/174; 436/181

(58) Field of Classification Search ..... 250/281, 250/282, 288; 252/408.1, 600; 463/173, 463/174, 181; 73/863
See application file for complete search history.

(56) References Cited

U.S. PATENT DOCUMENTS

| | | | | |
|---|---|---|---|---|
| 7,446,309 | B2 | 11/2008 | Murayama et al. | |
| 7,956,321 | B2 | 6/2011 | Murayama et al. | |
| 8,217,340 | B2 * | 7/2012 | Yoshimura et al. | 250/288 |
| 2001/0050351 | A1 * | 12/2001 | Saito et al. | 252/182.15 |
| 2003/0106997 | A1 * | 6/2003 | Beecher et al. | 250/288 |
| 2003/0138823 | A1 * | 7/2003 | Brock et al. | 435/6 |
| 2006/0024723 | A1 * | 2/2006 | Hussa et al. | 435/6 |
| 2006/0118711 | A1 * | 6/2006 | Murayama et al. | 250/287 |
| 2009/0266982 | A1 | 10/2009 | Yoshimura et al. | |
| 2011/0171363 | A1 | 7/2011 | Komatsu et al. | |

FOREIGN PATENT DOCUMENTS

JP 2009-264911 A 11/2009

OTHER PUBLICATIONS

Kuang Jen Wu et al., "Matrix-Enhanced Secondary Ion Mass Spectrometry: A Method for Molecular Analysis of Solid Surfaces," 68(5) Anal. Chem. pp. 873-882 (Mar. 1996).
A. Delcorte et al., "Organic Secondary Ion Mass Spectrometry: Sensitivity Enhancement by Gold Deposition," 74(19) Anal. Chem. 4955-4968 (Aug. 2002).
S.A. Parry et al., "Imaging Macrophages in Trehalose with SIMS," 255(4) Appl. Surf. Sci. 929-933 (Dec. 2008).

* cited by examiner

*Primary Examiner* — David A Vanore
(74) *Attorney, Agent, or Firm* — Fitzpatrick, Cella, Harper & Scinto

(57) ABSTRACT

Provided is a method that achieves both of soft ionization and high ionization efficiency of a substance to be analyzed at each measurement site without impairing a two-dimensional distribution state of the substance to be analyzed in desorption ionization mass spectrometry of a substance to be measured. By applying, to a substance to be analyzed, an ionization assisting reagent including an organic acid including a functional group represented by —$(CF_2)COOH$ and having a boiling point of 150° C. or more, and a polyhydric alcohol having a melting point of 20° C. or less and a boiling point of 150° C. or more at normal pressure, the organic acid, which is a component of the ionization assisting reagent, effectively donates a proton to the substance to be analyzed, thereby improving ionization efficiency, and the polyhydric alcohol, which is a component of the ionization assisting reagent, inhibits fragmentation.

9 Claims, No Drawings

INFORMATION ACQUISITION METHOD

BACKGROUND OF THE INVENTION

1. Field of the Invention

The present invention relates to an information acquisition method for acquiring information including a two-dimensional distribution state of a substance to be analyzed by an imaging mass spectrometry method using time-of-flight secondary ion mass spectrometry (hereinafter, referred to as TOF-SIMS), and more particularly, to an information acquisition method including subjecting an organic substance such as a lipid or a protein as a substance to be analyzed to high-sensitivity analysis.

2. Description of the Related Art

In the fields of biochemistry and medicine, there is a demand for acquisition of distribution information of a specific substance that constructs a biological tissue. As an example, in the field of medicine such as pathology, when distribution information of a specific antigen protein at a "cellular level" can be acquired in definitive diagnosis, a type of the disease can be determined and a therapy for the disease can be appropriately selected.

Conventionally acquisition of distribution information of a substance has been carried out by "immunostaining" including indirect observation of a substance to be detected using an antigen-antibody reaction of the substance. The immunostaining, however, has a problem of poor reproducibility due to the fact that an antibody is unstable and antigen-antibody reaction efficiency is difficult to control. Further, in the future, if the number of antigen proteins of interest providing evidence for definitive diagnosis becomes too large, e.g., when there arises a need of detection of more than hundreds of kinds of proteins, the current immunostaining cannot deal with the need.

Based on such backgrounds, there is an expectation for appearance of novel analysis techniques for exhaustively visualizing a substance to be detected. As one of the techniques, an imaging mass spectrometry method, which is an application of a mass spectrometry method, has been extensively developed in recent years.

The imaging mass spectrometry method is a technique for visualizing a two-dimensional distribution state of a specific substance in a sample by dividing any area in the sample of interest into smaller areas and analyzing each of the smaller areas by a mass spectrometry method. In the mass spectrometry method, relative intensity (mass spectrum) of each ion at each mass-to-charge ratio can be obtained by allowing an electric field or a magnetic field to act on a sample substance ionized in vacuum. A molecular weight of the detected substance can be determined from the mass-to-charge ratio of each ion peak in the resultant mass spectrum, and a mass of the substance can be determined from the height of the ion peak. Further, the mass can be divided by the molecular weight to determine an abundance of the substance. In addition, by subjecting each of the smaller areas to mass spectrometry and reconstructing an image using an ion peak of each substance included in the resultant mass spectrum, a two-dimensional distribution state of the specific substance can be imaged. Representative examples of the imaging mass spectrometry method include a secondary ion mass spectrometry method (SIMS) including irradiating each area with an ion as a primary probe (primary ion) and subjecting a secondary ion released by sputtering to mass spectrometry.

In order to allow measurement of a mass of a substance to be analyzed in a mass spectrometry method, it is necessary that the substance to be analyzed form an independent particulate state including, as a unit, an atom, a molecule, a cluster, or the like, and that the substance to be analyzed, in an independent particulate state, have a positive or negative charge. That is, it is necessary that, in mass spectrometry, desorption and ionization of a substance to be analyzed be achieved by some method.

Further, in order to assign a detected substance with high accuracy, it is preferred that both of inhibition of a degree of fragmentation of an ion to be analyzed, the so-called "soft ionization" and high ionization efficiency be achieved.

As a soft ionization method for proteins or lipids, or a variety of biologically-relevant molecules which are composite molecules of the proteins and lipids in SIMS analysis, there have been proposed, for example, a method including analyzing a mixed sample prepared by dispersing or dissolving a sample in a matrix substance (Analytical Chemistry 1996, 68, P. 873), a method including forming a metal thin layer on a sample by vapor deposition (Analytical Chemistry 2002, 74, P. 4955), and a method including laminating a nonvolatile liquid compound such as glycerol as a liquid matrix on a sample without destructing or dissolving the sample (Applied Surface Science 2008, 255, P. 929).

As a highly efficient ionization method for proteins or lipids, or a variety of biologically-relevant molecules which are composite molecules of the proteins and lipids, in SIMS analysis, there is known, for example, a method including carrying out cationization by protonation. The inventors of the present invention have hitherto proposed methods each of which achieves high ionization efficiency by detecting a trace amount of a biologically-relevant substance using an SIMS-specific sensitizing substance. For example, Japanese Patent Application Laid-Open No. 2009-264911 proposes a method including ionizing a substance to be analyzed over a long period of time or each measurement site uniformly with high efficiency by applying a fluorocarboxylic acid which has a strong proton-donating ability and is nonvolatile, to a sample.

SUMMARY OF THE INVENTION

However, even in the above-mentioned method, it is still difficult to achieve both of soft ionization and high ionization efficiency of a substance to be analyzed at each measurement site without impairing a two-dimensional distribution state of the substance to be analyzed.

The method proposed in Analytical Chemistry 1996, 68, P. 873 allows effective soft ionization of a substance to be analyzed, but it has a problem in that a distribution state of a substance is impaired in a sample preparation step.

The methods of Analytical Chemistry 2002, 74, P. 4955 and Applied Surface Science 2008, 255, P. 929 each have a problem in that ionization efficiency of a substance to be analyzed is low due to their generally small cationizing abilities on the substance to be analyzed as compared to a proton-donating action with an acid.

The method proposed in Japanese Patent Application Laid-Open No. 2009-264911 allows efficient ionization of a sample. However, its main aim is not effective soft ionization, and hence there is a problem in that, when a substance to be analyzed is a high molecular weight substance, fragmentation of an ion occurs, which makes it difficult to assign the substance to be analyzed.

The inventors of the present invention have found that both of soft ionization and high ionization efficiency of a substance to be analyzed can be achieved by the following method, and thus, the present invention has been completed.

That is, the present invention provides an information acquisition method for acquiring information including a mass, an abundance, and a two-dimensional distribution state of a substance to be analyzed by irradiating a sample having applied thereto an ionization assisting reagent with an ion as a primary probe to acquire a mass spectrum of a secondary ion released from the sample, in which the ionization assisting reagent includes an organic acid to be described in detail below including a functional group represented by the general formula (1) and having a boiling point of 150° C. or more at normal pressure, and a polyhydric alcohol having a melting point of 20° C. or less and a boiling point of 150° C. or more at normal pressure.

The present invention can simultaneously achieve an improvement in ionization efficiency by protonation of a substance to be analyzed due to attachment of an organic acid, and fragmentation inhibition by attachment of a polyhydric alcohol. The synergistic effect thereof allows highly efficient mass spectrometry and imaging in a wide molecular weight range.

Further features of the present invention will become apparent from the following description of exemplary embodiments.

DESCRIPTION OF THE EMBODIMENTS

Hereinafter, the present invention is described in detail. However, the following description is an example of embodiments of the present invention and it is not to limit the scope of the present invention.

The present invention includes an information acquisition method for acquiring information including a mass, an abundance, and a two-dimensional distribution state of a substance to be analyzed by irradiating a sample having applied thereto an ionization assisting reagent with an ion as a primary probe to acquire a mass spectrum of a secondary ion released from the sample, the method including:

(a) applying an ionization assisting reagent including an organic acid and a polyhydric alcohol to a substance to be analyzed; and (b) acquiring information including a mass of the substance to be analyzed by employing an imaging mass spectrometry method using an ion as a primary probe to acquire information including a two-dimensional distribution state of the substance to be analyzed based on the acquired information.

<Ionization Assisting Reagent>

An ionization assisting reagent to be utilized in the present invention contains an organic acid and a polyhydric alcohol. When an ionization assisting reagent having such composition is applied to a substance to be analyzed, the following actions can be simultaneously achieved. That is, the application of the organic acid improves ionization efficiency due to protonation, and the application of the polyhydric alcohol inhibits fragmentation. In addition, those actions are synergistically exhibited, and hence high effects of improving ionization efficiency and inhibiting fragmentation can be achieved as compared to the case of using each of the organic acid and the polyhydric alcohol alone, which allows highly efficient mass spectrometry and imaging in a wide molecular weight range.

As a protonation method for a biologically-relevant substance, there are known methods including using acids such as trifluoroacetic acid, hydrochloric acid, nitric acid, hydrofluoric acid, acetic acid, and formic acid. Those methods have been found to have some effects. However, out of the acids exemplified here, the strength of an organic acid other than trifluoroacetic acid is not so strong.

In contrast, the organic acid, which is a component of the ionization assisting reagent to be utilized in the present invention, is a substance including a functional group represented by the following general formula (1), and it has higher proton-donating property than those of acetic acid and formic acid because a carbon atom bonded to a carboxyl group has fluorine atoms with strong electron-withdrawing property.

$$—(CF_2)COOH \qquad \text{Formula (1)}$$

Thus, for example, even when the substance to be analyzed is a protein or a peptide which includes a large number of acidic amino acids, has a low isoelectric point, and thus is relatively difficult to protonate, effective protonation is expected to be enabled.

Further, inorganic acids such as hydrochloric acid and hydrofluoric acid and low molecular weight organic acids such as trifluoroacetic acid, nitric acid, acetic acid, and formic acid each have volatility. Therefore, when any of those acids is used as a proton-donating substance for a substance to be analyzed, a proton-donating action may be reduced through time-dependent volatilization.

As a nonvolatile acid, there may be used, for example, sulfuric acid. However, since sulfuric acid has strong oxidative power, it may cause dehydration and oxidation reactions of a sample to remarkably denature the sample when being applied to the sample. Similarly, nitric acid may denature a sample through nitration although the boiling point is as relatively high as about 120° C. in an azeotropic mixture with water.

In contrast, since the above mentioned organic acid, which is a component of the ionization assisting reagent to be utilized in the present invention, has a boiling point of 150° C. or more at normal pressure, it can stably function as a proton-donating agent for a substance to be analyzed over a long period of time without being immediately volatilized even under a vacuum condition in a mass spectrometer. An organic acid having a boiling point of 200° C. or more is preferred, but an organic acid having a boiling point of 100° C. or more may also be used depending on a substance to be detected.

The organic acid is described in more detail. The organic acid preferably includes two or more functional groups each represented by the formula (1) per molecule thereof, and preferably includes two or three functional groups from the viewpoint of ease of handling. Although a structure other than a moiety represented by the formula (1) is not particularly limited, a unit that does not cause a reduction in proton-donating ability as the entire molecule is preferably used.

Since a boiling point can be increased without reducing a proton-donating action on a substance to be analyzed by increasing a chain length of a perfluoroalkylene chain, a perfluorodicarboxylic acid including functional groups each represented by the formula (1) at both terminals of a perfluoroalkylene chain can be more preferably used. When the number n of carbons in the perfluoroalkylene chain is $n<7$, the organic acid has high solubility in water at room temperature and hence it is preferred from the viewpoint of operational convenience. On the other hand, in the case of $n=1$, the strength of the acid becomes weak as compared to the case of $n\geqq 2$, and hence the organic acid may insufficiently function as a proton-donating agent. For that reason, the organic acid is particularly preferably a dicarboxylic acid represented by the following general formula (2).

$$HOOC—(CF_2)_n—COOH \quad 2\leqq n\leqq 6 \qquad \text{Formula (2)}$$

The ionization assisting reagent to be utilized in the present invention allows the soft ionization of a biologically-relevant substance by subjecting a sample having applied thereto a polyhydric alcohol such as glycerol as well as the organic acid to analysis. Glycerol has been widely utilized as a matrix agent that allows the soft ionization of a sample from long ago. Although the detailed mechanisms have not been completely understood yet, as a matrix agent particularly in the case of employing a fast atom bombardment method (FAB) or Liquid-SIMS, a variety of polyhydric alcohols, which are hardly volatile and have similar molecular structures, such as polyethylene glycol, have been studied in the past, and have been reported to have some effective functions on the soft ionization of a sample molecule.

When the polyhydric alcohol, which is a component of the ionization assisting reagent to be used in the present invention, is a substance having a melting point of 20° C. or more at normal pressure, the polyhydric alcohol is applied as an aqueous solution to a sample, and the sample is then exposed to vacuum in a mass spectrometer, with the result that the dryness and precipitation of the polyhydric alcohol as a solute due to evaporation of a solvent may occur. In this case, in general, the precipitated solid is inhomogeneous, which may cause unevenness in strength of an ionization assisting action in each analysis area. This becomes a problem in using the ionization assisting reagent in an imaging mass spectrometry method in some cases.

Further, when the polyhydric alcohol, which is a component of the ionization assisting reagent to be used in the present invention, is a substance having a boiling point of 150° C. or more at normal pressure, the polyhydric alcohol can provide actions of fragmentation inhibition and soft ionization on a substance to be analyzed over a long period of time without being immediately volatilized even under a vacuum condition in a mass spectrometer.

In view of the foregoing, the polyhydric alcohol, which is a component of the ionization assisting reagent to be utilized in the present invention, is preferably an alcohol having a melting point of 20° C. or less and a boiling point of 150° C. or more at normal pressure and including two or more hydroxy groups per molecule thereof. The use of such polyhydric alcohol can prevent the dryness and precipitation of the polyhydric alcohol as a solute due to evaporation of a solvent and achieve uniform ionization of each measurement site. Further, the polyhydric alcohol is not immediately volatilized, which allows ionization over a long period of time.

The polyhydric alcohol is preferably at least one kind of substance selected from the group consisting of ethylene glycol, propylene glycol, diethylene glycol, and glycerol from the viewpoint of ease of availability as well.

In particular, in measuring an organic substance such as a lipid or a protein as a substance to be analyzed, the measurement is normally carried out in an environment controlled to a temperature equal to or less than room temperature from the viewpoint of inhibiting a dehydration reaction and heat decomposition. The above-mentioned substances each have low volatility at room temperature (20° C.). Ethylene glycol, propylene glycol, diethylene glycol, and glycerol have vapor pressures of 8 Pa, 10.7 Pa, <1 Pa, and <1 Pa, respectively, and thus can each be brought into contact with a sample over a long period of time.

Further, a mixing ratio between the organic acid and the polyhydric alcohol, which are components of the ionization assisting reagent to be used in the present invention, may be appropriately determined depending on a substance to be detected. In this regard, however, a preferred mixing ratio falls within the range of 0.001 to 1,000, preferably 0.01 to 100, more preferably 0.1 to 10 in terms of a molar ratio of [polyhydric alcohol]/[organic acid].

In applying the ionization assisting reagent to be used in the present invention to a sample, a conventionally known solvent may be used. However, a polar solvent such as water is preferably contained in consideration of a proton-donating action on a substance to be analyzed.

An application method for the ionization assisting reagent to be used in the present invention is exemplified by a treatment including droping, onto a substance to be analyzed, a droplet including the ionization assisting reagent to be ejected from a pipetter or an ink jet printer, or a treatment including immersing a substance to be analyzed in an aqueous solution including the ionization assisting reagent.

<Mass Spectrometry Method>

The present invention may be applied for any mass spectrometry methods. Especially, it may be suitably applied for time-of-flight secondary ion mass spectrometry (TOF-SIMS), which is provided with a mechanism for irradiating a sample with an ion as a primary beam, accelerates an ion desorbed from the sample in an extraction electrode to attract the ion to an analysis unit, and acquires information including a mass of a substance to be analyzed through a time-of-flight mechanism in the analysis unit.

That is, the information acquisition method according to an embodiment of the present invention includes: irradiating a sample having applied thereto an ionization assisting reagent with a primary ion beam; and acquiring mass information by detecting a secondary ion released from the sample, in which the ionization assisting reagent includes an organic acid including a functional group represented by the general formula (1) and having a boiling point of 150° C. or more at normal pressure, and a polyhydric alcohol having a melting point of 20° C. or less and a boiling point of 150° C. or more at normal pressure.

EXAMPLES

Hereinafter, the present invention is more specifically described by way of examples. The following specific examples are each an example of the best mode for carrying out the present invention. However, the present invention is by no means limited to such specific mode.

Example 1

In this example, mass spectrometry was carried out using a TOF-SIMS apparatus (TOF-SIMS 5 type manufactured by ION-TOF). A glass substrate with an ITO vapor deposition layer (Sigma-Aldrich, 1×1 inch, #576352) was used as a support for a specimen. A frozen tissue section of murine pancreas (thickness: 5 μm) was mounted onto the substrate and adhered thereto by thawing. After that, the whole was shaken for 5 minutes while distilled water exchange being carried out, followed by a drying treatment in a vacuum desiccator for 30 minutes. To the entire surface of the dried tissue section on the substrate, a 10% (w/w) glycerol (MP: 17.8° C., BP: 290° C.)–0.1% (w/w) perfluorosuberic acid (BP: 205° C.) aqueous solution as an ionization assisting reagent was applied using a micropipetter to such an extent that the specimen became wet. The sample was placed in the TOF-SIMS apparatus and analyzed under the following measurement conditions. The detection position and detection sensitivity of an ion corresponding to m/z of interest were reconstructed as two-dimensional images based on information and measured data of each measurement position.

The detection sensitivity of a peptide component at m/z 1,197 was evaluated in order to estimate an effect of the ionization assisting reagent. Table 1 shows the results.

(Measurement Conditions)

Primary ion: 25 kV $Bi^{3+}$, 1 pA (pulse current value), random scan mode

Primary ion pulse frequency: 5 kHz (200 μs/shot)

Primary ion pulse width: about 1 nanosecond

Primary ion beam diameter: about 1 μm

Measurement area: area measuring 500 μm×500 μm in pars exocrina pancreatis

Number of points of measurement of secondary ion: 128×128 points

Integration time: scanned 16 times (about 52 seconds)

Secondary ion extraction electrode voltage: −2 kV

Secondary ion detection mode: positive ion

TABLE 1

| | Polyhydric alcohol | Organic acid | | Boiling point of organic acid (atmospheric pressure) | Detection sensitivity (m/z 1,197) |
|---|---|---|---|---|---|
| Example 1 | Glycerol | Perfluorosuberic acid | HOOC—$(CF_2)_6$—COOH | 205° C. | +++ |
| Example 2 | Ethylene glycol | Perfluorosuberic acid | HOOC—$(CF_2)_6$—COOH | 205° C. | +++ |
| Example 3 | Diethylene glycol | Perfluorosuberic acid | HOOC—$(CF_2)_6$—COOH | 205° C. | +++ |
| Example 4 | Propylene glycol | Perfluorosuberic acid | HOOC—$(CF_2)_6$—COOH | 205° C. | +++ |
| Example 5 | Glycerol | Terafluorosuccinic acid | HOOC—$(CF_2)_2$—COOH | 150° C. | +++ |
| Comparative Example 1 | — | — | | | |
| Comparative Example 2 | — | Perfluorosuberic acid | HOOC—$(CF_2)_6$—COOH | 205° C. | + |
| Comparative Example 3 | — | Terafluorosuccinic acid | HOOC-$(CF_2)_2$—COOH | 150° C. | + |
| Comparative Example 4 | — | Trifluoroacetic acid | $CF_3COOH$ | 73° C. | + |
| Comparative Example 5 | Glycerol | Trifluoroacetic acid | $CF_3COOH$ | 73° C. | + |
| Comparative Example 6 | Glycerol | — | — | | + |
| Comparative Example 7 | Ethylene glycol | — | — | | + |
| Comparative Example 8 | Diethylene glycol | — | — | | − |
| Comparative Example 9 | Propylene glycol | — | — | | − |

Symbol

+++ Four times or more as high as that of Comparative Example 1

++ Twice or more as high as that of Comparative Example 1

+ Equal to or higher than that of Comparative Example 1

− Lower than that of Comparative Example 1

Example 2

The same operation as that in Example 1 was carried out except that a 10% (w/w) ethylene glycol−0.1% (w/w) perfluorosuberic acid aqueous solution was used as the ionization assisting reagent. The detection sensitivity of a peptide component at m/z 1,197 was evaluated in order to estimate an effect of the ionization assisting reagent. Table 1 shows the results.

Example 3

The same operation as that in Example 1 was carried out except that a 10% (w/w) diethylene glycol−0.1% (w/w) perfluorosuberic acid aqueous solution was used as the ionization assisting reagent. The detection sensitivity of a peptide component at m/z 1,197 was evaluated in order to estimate an effect of the ionization assisting reagent. Table 1 shows the results.

Example 4

The same operation as that in Example 1 was carried out except that a 10% (w/w) propylene glycol−0.1% (w/w) perfluorosuberic acid aqueous solution was used as the ionization assisting reagent. The detection sensitivity of a peptide component at m/z 1,197 was evaluated in order to estimate an effect of the ionization assisting reagent. Table 1 shows the results.

Example 5

The same operation as that in Example 1 was carried out except that a 10% (w/w) glycerol-0.1% (w/w) tetrafluorosuccinic acid aqueous solution was used as the ionization assisting reagent. The detection sensitivity of a peptide component at m/z 1,197 was evaluated in order to estimate an effect of the ionization assisting reagent. Table 1 shows the results.

Comparative Example 1

For comparison, the same operation as that in Example 1 was carried out except that no ionization assisting reagent was applied. An ionization assisting effect in each of Examples 1 to 5 and Comparative Examples to 9 was estimated with reference to the detection sensitivity of a peptide component at m/z 1,197 in Comparative Example 1.

Comparative Example 2

For comparison, the same operation as that in Comparative Example 1 was carried out except that a 0.1% (w/w) perfluorosuberic acid aqueous solution alone was applied to a specimen. The detection sensitivity of a peptide component at m/z 1,197 was evaluated. Table 1 shows the results.

Comparative Example 3

For comparison, the same operation as that in Comparative Example 1 was carried out except that a 0.1% (w/w) tetrafluorosuccinic acid aqueous solution alone was applied to a specimen. The detection sensitivity of a peptide component at m/z 1,197 was evaluated. Table 1 shows the results.

Comparative Example 4

For comparison, the same operation as that in Comparative Example 1 was carried out except that a 0.1% (w/w) trifluoroacetic acid aqueous solution alone was applied to a specimen. The detection sensitivity of a peptide component at m/z 1,197 was evaluated. Table 1 shows the results.

Comparative Example 5

For comparison, the same operation as that in Comparative Example 1 was carried out except that a 10% (w/w) glycerol-0.1% (w/w) trifluoroacetic acid aqueous solution was applied to a specimen. The detection sensitivity of a peptide component at m/z 1,197 was evaluated. Table 1 shows the results.

Comparative Example 6

For comparison, the same operation as that in Comparative Example 1 was carried out except that a 10% (w/w) glycerol aqueous solution was applied to a specimen. The detection sensitivity of a peptide component at m/z 1,197 was evaluated. Table 1 shows the results.

Comparative Example 7

For comparison, the same operation as that in Comparative Example 1 was carried out except that a 10% (w/w) ethylene glycol aqueous solution was applied to a specimen. The detection sensitivity of a peptide component at m/z 1,197 was evaluated. Table 1 shows the results.

Comparative Example 8

For comparison, the same operation as that in Comparative Example 1 was carried out except that a 10% (w/w) diethylene glycol aqueous solution was applied to a specimen. The detection sensitivity of a peptide component at m/z 1,197 was evaluated. Table 1 shows the results.

Comparative Example 9

For comparison, the same operation as that in Comparative Example 1 was carried out except that a 10% (w/w) propylene glycol aqueous solution was applied to a specimen. The detection sensitivity of a peptide component at m/z 1,197 was evaluated. Table 1 shows the results.

Example 6

In this example, mass spectrometry was carried out using a TOF-SIMS apparatus (TOF-SIMS 5 type manufactured by ION-TOF). A glass substrate with an ITO vapor deposition layer (Sigma-Aldrich, 1×1 inch, #576352) was used as a support for a specimen. The substrate on which a solution of a dipalmitoyl glycerophospholipid (DPPC) in methanol was printed with a circular shape having a diameter of 0.1 mm using an ink jet apparatus was used as a sample. To the entire surface of a lipid dot on the dried substrate, a glycerol-0.1% (w/w) perfluorosuberic acid aqueous solution as an ionization assisting reagent, which had been prepared so that a mixing ratio between a polyhydric alcohol and an organic acid was 1,000 in terms of a molar ratio, was applied using a spin coater. The sample was placed in the TOF-SIMS apparatus and analyzed under the following measurement conditions.

The detection position and detection sensitivity of an ion corresponding to m/z of interest were reconstructed as two-dimensional images based on information and measured data of each measurement position.

(Measurement Conditions)

Primary ion: 25 kV $Bi^{3+}$, 1 pA (pulse current value), random scan mode

Primary ion pulse frequency: 5 kHz (200 μs/shot)

Primary ion pulse width: about 1 nanosecond

Primary ion beam diameter: about 1 μm

Number of points of measurement of secondary ion: 128×128 points

Integration time: scanned 16 times (about 52 seconds)

Secondary ion extraction electrode voltage: −2 kV

Secondary ion detection mode: positive ion

An effect of the ionization assisting reagent was evaluated based on the detection number of a parent ion at m/z 734 detected by this measurement, a ratio between the detection number and the total detection number of fragment ions appearing at m/z 58, m/z 86, m/z 184, and m/z 224, and the detection sensitivity of the parent ion at m/z 734. Table 2 shows the results.

TABLE 2

| | Measured substance | Polyhydric alcohol | Organic acid | [Polyhydric alcohol]/[Organic acid] | [Full-length ion]/[Fragment ion] | Detection sensitivity (m/z 734) |
|---|---|---|---|---|---|---|
| Example 6 | Phospholipid (DPPC) | Glycerol | Perfluorosuberic acid | 1,000 | +++ | + |
| Example 7 | Phospholipid (DPPC) | Glycerol | Perfluorosuberic acid | 10 | +++ | +++ |
| Example 8 | Phospholipid (DPPC) | Glycerol | Perfluorosuberic acid | 0.1 | +++ | +++ |
| Example 9 | Phospholipid (DPPC) | Glycerol | Perfluorosuberic acid | 0.001 | + | ++ |
| Comparative Example 10 | Phospholipid (DPPC) | | | | | |
| Comparative Example 11 | Phospholipid (DPPC) | Glycerol | Perfluorosuberic acid | 0.0001 | + | + |

TABLE 2-continued

| | Measured substance | Polyhydric alcohol | Organic acid | [Polyhydric alcohol]/[Organic acid] | [Full-length ion]/[Fragment ion] | Detection sensitivity (m/z 734) |
|---|---|---|---|---|---|---|
| Comparative Example 12 | Phospholipid (DPPC) | Ethanol | Perfluorosuberic acid | 10 | + | + |
| Comparative Example 13 | Phospholipid (DPPC) | Dextran | Perfluorosuberic acid | 10 | + | − |
| Comparative Example 14 | Phospholipid (DPPC) | PEG1000 | Perfluorosuberic acid | 10 | + | − |
| Comparative Example 15 | Phospholipid (DPPC) | Trehalose | Perfluorosuberic acid | 10 | + | − |

Symbol
+++ Four times or more as high as that of Comparative Example 10
++ Twice or more as high as that of Comparative Example 10
+ Equal to or higher than that of Comparative Example 10
− Lower than that of Comparative Example 10

Example 7

The same operation as that in Example 6 was carried out except that a glycerol-perfluorosuberic acid aqueous solution prepared so that the mixing ratio between the polyhydric alcohol and the organic acid was 10 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Example 8

The same operation as that in Example 6 was carried out except that a glycerol-perfluorosuberic acid aqueous solution prepared so that the mixing ratio between the polyhydric alcohol and the organic acid was 0.1 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Example 9

The same operation as that in Example 6 was carried out except that a glycerol-perfluorosuberic acid aqueous solution prepared so that the mixing ratio between the polyhydric alcohol and the organic acid was 0.001 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Comparative Example 10

For comparison, the same operation as that in Example 6 was carried out except that no ionization assisting reagent was applied. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results. An ionization assisting effect in each of Examples 6 to 9 and Comparative Examples 10 to 15 was estimated with reference to the results in Comparative Example 10.

Comparative Example 11

The same operation as that in Example 6 was carried out except that a glycerol-perfluorosuberic acid aqueous solution prepared so that the mixing ratio between the polyhydric alcohol and the organic acid was 0.0001 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Comparative Example 12

The same operation as that in Example 6 was carried out except that an ethanol-perfluorosuberic acid aqueous solution prepared so that the mixing ratio between the alcohol and the organic acid was 10 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Comparative Example 13

The same operation as that in Example 6 was carried out except that a dextran-perfluorosuberic acid aqueous solution prepared so that the mixing ratio between the polyhydric alcohol and the organic acid was 10 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Comparative Example 14

The same operation as that in Example 6 was carried out except that a PEG1000-perfluorosuberic acid aqueous solution prepared so that the mixing ratio between the polyhydric alcohol and the organic acid was 10 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

Comparative Example 15

The same operation as that in Example 6 was carried out except that a trehalose-perfluorosuberic acid aqueous solution prepared so that the mixing ratio between the polyhydric alcohol and the organic acid was 10 in terms of a molar ratio was used. An effect of the ionization assisting reagent was evaluated based on the detection number of a parent ion at m/z 734 detected, a ratio between the detection number and the total detection number of fragment ions appearing at m/z 58, m/z 86, m/z 184, and m/z 224, and the detection sensitivity of the parent ion at m/z 734. Table 2 shows the results.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-008858, filed Jan. 19, 2011, which is hereby incorporated by reference herein in its entirety.

What is claimed is:

1. An information acquisition method for acquiring information including a mass, an abundance, and a two-dimensional distribution state of a substance to be analyzed by irradiating a sample having applied thereto an ionization assisting reagent with an ion as a primary probe to acquire a mass spectrum of a secondary ion released from the sample, wherein the ionization assisting reagent comprises an organic acid including a functional group represented by the following general formula (1) and having a boiling point of 150° C. or more at normal pressure, and a polyhydric alcohol having a melting point of 20° C. or less and a boiling point of 150° C. or more at normal pressure $$—(CF_2)COOH \qquad \text{Formula (1).}$$

2. The information acquisition method according to claim 1, wherein the substance to be analyzed comprises one of a protein, a peptide, a lipid, and a composite molecule thereof.

3. The information acquisition method according to claim 1, wherein the acquiring of the information including the mass, abundance, and two-dimensional distribution state of the substance to be analyzed is carried out by time-of-flight secondary ion mass spectrometry.

4. The information acquisition method according to claim 1, wherein the organic acid comprises a substance represented by the following general formula (2)

$$HOOC—(CF_2)_n—COOH 2 \leqq n \leqq 6 \qquad \text{Formula (2).}$$

5. The information acquisition method according to claim 1, wherein the organic acid comprises perfluorosuberic acid.

6. The information acquisition method according to claim 1, wherein the polyhydric alcohol comprises at least one kind of substance selected from the group consisting of ethylene glycol, propylene glycol, diethylene glycol, and glycerol.

7. The information acquisition method according to claim 1, wherein the ionization assisting reagent is applied to the substance to be analyzed by one of dropping, onto the substance to be analyzed, a droplet including the ionization assisting reagent to be ejected from one of a pipetter and an ink jet printer, and immersing the substance to be analyzed in an aqueous solution including the ionization assisting reagent.

8. The information acquisition method according to claim 1, wherein a mixing ratio between the organic acid and the polyhydric alcohol in the ionization assisting reagent falls within a range of 0.001 to 1,000 in terms of a molar ratio.

9. An information acquisition method, comprising:

irradiating a sample having applied thereto an ionization assisting reagent with a primary ion beam; and acquiring mass information by detecting a secondary ion released from the sample, wherein the ionization assisting reagent comprises an organic acid including a functional group represented by the following general formula (1) and having a boiling point of 150° C. or more at normal pressure, and a polyhydric alcohol having a melting point of 20° C. or less and a boiling point of 150° C. or more at normal pressure $$—(CF_2)COOH \qquad \text{Formula (1).}$$

* * * * *